United States Patent [19]

Collins

[11] Patent Number: 4,925,031

[45] Date of Patent: May 15, 1990

[54] DISPLAY HAVING CONTAINER MEANS

[75] Inventor: Karen D. Collins, Muncie, Ind.

[73] Assignee: General Motors Corporation, Detroit, Mich.

[21] Appl. No.: 329,176

[22] Filed: Mar. 27, 1989

[51] Int. Cl.[5] ..... B65D 5/52

[52] U.S. Cl. ..... 206/486; 206/425

[58] Field of Search ..... 206/486, 487, 477, 482, 206/425, 45.14, 44 R

[56] References Cited

U.S. PATENT DOCUMENTS

| | | | |
|---|---|---|---|
| 726,380 | 4/1903 | Ullathorne | 206/45.14 |
| 1,460,185 | 6/1923 | Webster | 206/45.14 |
| 1,949,376 | 3/1934 | Mansfield et al. | 206/45.14 |
| 2,161,018 | 6/1939 | Clemens | 206/45.14 |
| 2,300,412 | 11/1942 | Fink | 206/44 R |
| 2,748,927 | 1/1952 | Crane, Jr. | 206/44 R |
| 3,130,833 | 4/1964 | Glasser et al. | 206/477 |
| 4,121,752 | 10/1978 | Ravotto et al. | 206/486 |
| 4,194,617 | 3/1980 | Bandell | 206/45.14 |
| 4,197,939 | 4/1980 | Dogliotti | 206/44 R |
| 4,503,975 | 3/1985 | Meyers et al. | 206/486 |

FOREIGN PATENT DOCUMENTS

| | | | |
|---|---|---|---|
| 0503467 | 6/1951 | Belgium | 206/45.14 |
| 0524291 | 8/1940 | United Kingdom | 206/45.14 |

*Primary Examiner*—Paul T. Sewell
*Assistant Examiner*—Jacob K. Ackun, Jr.
*Attorney, Agent, or Firm*—C. R. Meland

[57] ABSTRACT

An advertising display comprises a display member that carries a container which may be a literature holder. The display member is formed of cardboard and is scored. To create an opening for insertion of the container in a front panel of the display member, a flap portion of the front panel is separated and moved rearwardly. A locking brace is moved upwardly out of the plane of a bottom or lower support panel of the display member. When the container is assembled, the locking brace prevents rearward movement of the container. The flap portion is secured to a rear wall of the container by a pressure sensitive tape.

3 Claims, 1 Drawing Sheet

DISPLAY HAVING CONTAINER MEANS

This invention relates to an advertising display and more particularly to an advertising display that includes a means for supporting a literature holder or box for containing literature or other items.

Displays that are formed from cardboard that include a display tray that is supported by a base are known one example being the display disclosed in the Taub U.S. Pat. No. 4,411,382.

This invention differs from the above mentioned Taub patent in that, among other things, it includes a new and improved means for supporting a container or box which may be used to contain advertising literature.

IN THE DRAWINGS

Figure 1:
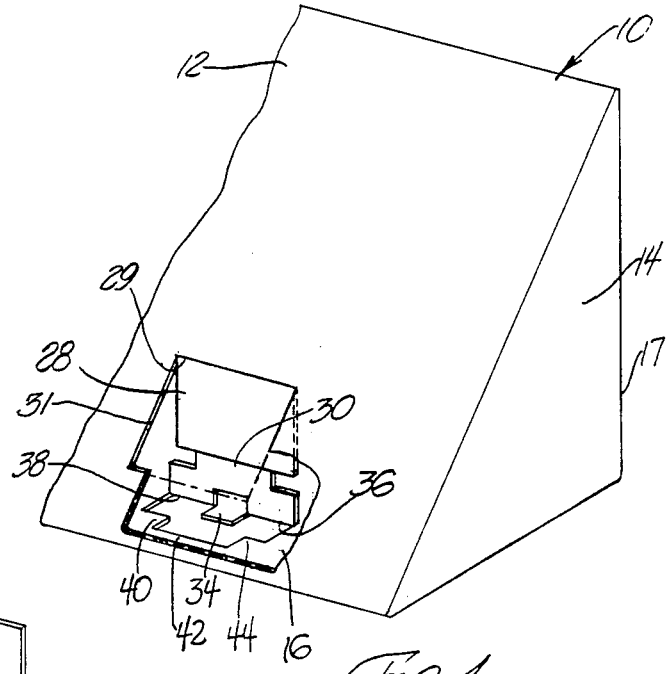
FIG. 1 is a perceptive view of a display made in accordance with this invention prior to the assembly of the literature holder shown in FIG. 2.

Referring now to the drawings, and more particularly FIG. 1, the reference numeral 10 generally designates a display that is formed of cardboard and which is erected from a scored flat blank of cardboard material. The display 10 has a front panel 12, opposed side panels 14, a bottom panel 16 and a rear panel 17. The front 12 slants rearwardly at about a 60 degree angle to the bottom panel 16.

The display is erected from the scored blank by bending or folding the various panels and then securing them together by suitable tab locks and slots that have not been illustrated.

The outer surface of panel 12 is printed with advertising. The bottom panel 16 supports the display and may be placed on a counter or other flat surface. Adhesive strips may be used to secure the bottom panel 16 to its supporting surface such as a counter.

Figure 2:
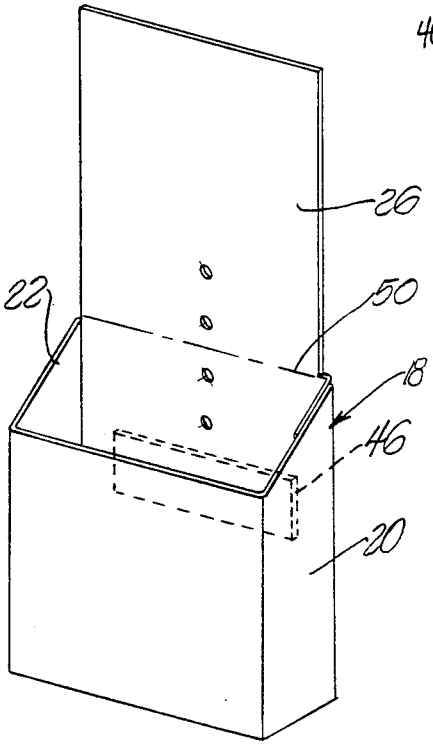
FIG. 2 is a perspective view of a literature box or container that is supported by the display shown in FIG. 1.

The display 10 supports a container or literature holder 18 shown in FIG. 2. The container 18 is formed of a clear or transparent plastic material so that literature placed therein can be seen. The container 18 comprises a box portion 20 having one open end 22 for receiving the advertising literature. The lower end of the box portion 20 is closed by a bottom wall 24. The container 18 has a flap portion 26.

The method of securing the literature box or holder 18 to display 10 will now be described. The front panel 12 is scored to provide a flap or back panel portion 28 which is separated from panel 12 by pushing it rearwardly out of the plane of panel 12 to the position shown in FIGS. 2 and 3. Portion 28 remains attached to panel 12 along line 29 so that portion 28 is pivotally supported along line 29. This creates a rectangular opening 31 in panel 12 for receiving literature holder 18. The opening 31 is the same size as flap 28. The bottom panel or lower wall 16 of display 10 is also scored to permit a locking brace 30 to be formed. The locking brace 30 is formed by moving it out of the plane of panel 16 to the position illustrated in FIGS. 1 and 3. When brace 30 is formed, an opening 32 is created in bottom panel 16 as is a tab portion 34 which remains and which is in the plane of panel 16. Brace 30 remains attached to panel 16 along lines 36 and 38. Brace 30 is pivotally supported by panel 16 along lines 36 and 38.

Figure 3:
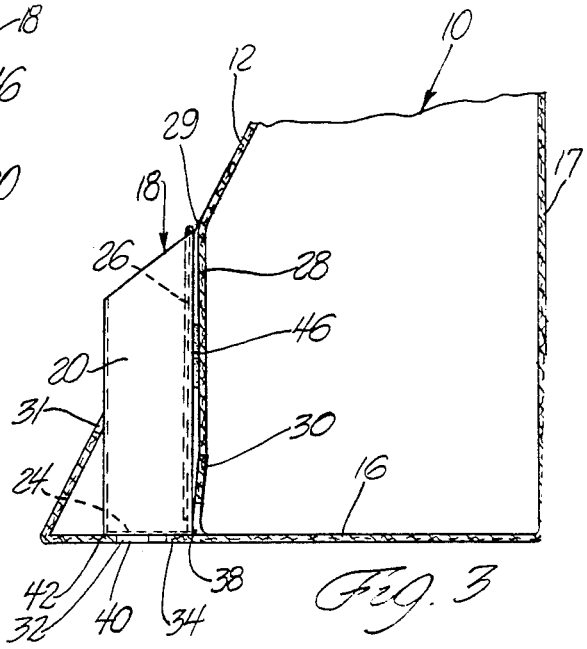
FIG. 3 is a sectional view of a portion of the display shown in FIG. 1 showing the literature box of FIG. 2 secured to the display of FIG. 1.

When parts 28 and 30 have been formed, the literature holder 18 is assembled to display 10. The portion 20 of holder 18 is inserted into the opening 31 that is created when part 28 is folded back. The width of portion 20 is about the same as the width of opening 31 with just enough clearance to allow portion 20 to be inserted into opening 31. When the box 20 portion is fully inserted, its bottom wall 24 engages surface portions 40, 42 and 44 of bottom panel 16 and an upper surface a portion of tab 34. When the box portion 20 assembled in a vertical position, a rear wall portion of box portion 20 engages the locking brace 30, as shown in FIG. 3.

The rear wall of box portion 20 has a strip 46 of pressure sensitive adhesive tape attached thereto. The opposite side of this strip of tape has a backing strip which is removed just before the literature holder 18 is inserted into the opening 31 in panel 12. After the holder 18 has been inserted, the flap 28 is moved to a position where it engages the pressure sensitive adhesive strip 46 to thereby secure flap 28 to holder 18 as shown in FIG. 3. This can be accomplished by arranging display 10 so that side panels 14 are locked in place last, thereby leaving an opening to the inside of the display 10 that permits access of a person's hand into the display 10 to push flap 28 against the outer side of tape 46.

The flap 26 of holder 18 is folded down into the interior of box-portion 20 in the final assembled condition of the display. This is illustrated in FIG. 3. The flap 26 is folded about a crease 50 formed in holder 18.

It will be appreciated that in the final assembled condition of holder 18, the holder is securely fastened to display 10. Thus, locking brace 30 prevents rearward movement of holder 18. Further, flap 28, which is secured to holder 18 by pressure sensitive tape 46 prevents movement of holder 18 relative to flap 28.

The embodiments of the invention in which an exclusive property or privilege is claimed are defined as follows:

1. An advertising display having a container comprising, a display member having a lower support panel that is adapted to rest on a support and a front panel extending from said lower support panel, said lower support panel having an integral locking brace pivotally connected to said lower support panel and extending upwardly therefrom toward said front panel, the upper edge of said locking brace being completely disconnected from said front panel, an opening in said front panel, and a container have a box portion projecting through said opening in said front panel, the bottom of said box portion engaging portions of said lower support panel and a rear portion of said box portion engaging said locking brace, said locking brace preventing rearward movement of said container relative to said display member.

2. The advertising display according to claim 1 where said locking brace is formed by pushing it out of the plane of said lower support panel to thereby form an opening in said lower support panel, said locking brace being so-shaped that a tab integral with said lower support panel is located in said opening, said tab engaging the bottom of said container.

3. The advertising display according to claim 1 where said front panel carries a flap member which is integral with and pivoted to said front panel and which is secured to a rear wall of said container by a strip of adhesive material, said flap member and locking brace being substantially aligned with each other.

* * * * *